US005238070A

United States Patent [19]

Schultz et al.

[11] Patent Number: 5,238,070

[45] Date of Patent: * Aug. 24, 1993

[54] DIFFERENTIAL ACTUATING SYSTEM FOR DOWNHOLE TOOLS

[75] Inventors: Roger L. Schultz, Richardson; Kevin R. Manke, Flower Mound; Neal G. Skinner, Lewisville, all of Tex.

[73] Assignee: Halliburton Company, Duncan, Okla.

[ * ] Notice: The portion of the term of this patent subsequent to Apr. 7, 2009 has been disclaimed.

[21] Appl. No.: 838,373

[22] Filed: Feb. 19, 1992

Related U.S. Application Data

[63] Continuation of Ser. No. 658,479, Feb. 20, 1991, Pat. No. 5,101,907.

[51] Int. Cl.[5] ..... E21B 7/12; E21B 34/10

[52] U.S. Cl. ..... 166/386; 166/319; 166/336

[58] Field of Search ..... 166/386, 319, 320, 321, 166/336, 264, 250

[56] References Cited

U.S. PATENT DOCUMENTS

| | | | |
|---|---|---|---|
| 3,779,263 | 12/1973 | Edwards et al. | 137/68 |
| 3,856,085 | 12/1974 | Holden et al. | 166/264 |
| 4,113,012 | 9/1978 | Evans et al. | 166/264 |
| 4,234,043 | 11/1980 | Roberts | 166/336 |
| 4,252,195 | 2/1981 | Fredd | 166/314 |
| 4,258,793 | 3/1981 | McGraw et al. | 166/315 |
| 4,347,900 | 9/1982 | Barrington | 166/380 |
| 4,375,239 | 3/1983 | Barrington et al. | 166/336 |
| 4,378,850 | 4/1983 | Barrington | 166/373 |
| 4,403,659 | 9/1983 | Upchurch | 166/374 |
| 4,422,506 | 12/1983 | Beck | 166/324 |
| 4,583,593 | 4/1986 | Zunkel et al. | 166/382 |
| 4,711,305 | 12/1987 | Ringgenberg | 166/336 |
| 4,796,699 | 1/1989 | Upchurch | 166/250 |
| 4,856,595 | 8/1989 | Upchurch | 166/374 |
| 4,866,607 | 9/1989 | Anderson et al. | 364/422 |
| 4,896,722 | 1/1990 | Upchurch | 166/250 |
| 4,915,168 | 4/1990 | Upchurch | 166/250 |
| 4,979,568 | 12/1990 | Spencer, III et al. | 166/374 |

*Primary Examiner*—William P. Neuder
*Attorney, Agent, or Firm*—James R. Duzan; L. Wayne Beavers

[57] ABSTRACT

A differential pressure actuating system for downhole tools provides endless operation by the use of the differential pressure between two isolated zones of a well as a power source for the tool. That differential pressure is applied across a power transfer element to operate the downhole tool.

6 Claims, 10 Drawing Sheets

DIFFERENTIAL ACTUATING SYSTEM FOR DOWNHOLE TOOLS

This is a continuation of copending application Ser. No. 07/658,479 filed on Feb. 20, 1991, now U.S. Pat. No. 5,101,907.

BACKGROUND OF THE INVENTION

1. Field of the Invention

The present invention relates generally to a system for actuating downhole tools using a fluid pressure differential defined in a well as a power source.

2. Description of the Prior Art

The basic function of most downhole tools involves surface manipulation of a downhole operation system to accomplish a task such as opening a valve, for example the opening and closing of a tester valve or a circulation valve.

This process usually involves a power piston which works off a pressure differential acting across a hydraulic area.

There are several ways in which this pressure differential can be achieved.

One technique is the use of a nitrogen charged system in which the nitrogen acts as a spring which supports hydrostatic well annulus pressure, but which can be further compressed with applied pressure at the surface allowing linear actuation across a hydraulic area downhole. An example of such a tool is seen in U.S. Pat. No. 4,711,305 to Ringgenberg.

Another system uses the differential between hydrostatic pressure and an atmospheric air chamber. An example of such a system is seen in U.S. Pat. Nos. 4,896,722; 4,915,168; 4,796,699 and 4,856,595 to Upchurch.

Yet another system provides first and second pressure conducting passages from either side of the power piston to the well annulus. A metering orifice type of retarding means is disposed in the second pressure conducting passage for providing a time delay in communication of changes in well annulus pressure to the second side of the power piston. Accordingly, a rapid increase or rapid decrease in well annulus pressure causes a temporary pressure differential across the piston which moves the piston. An example of such a system is seen in U.S. Pat. No. 4,422,506 to Beck.

Still another approach is to provide both high and low pressure sources within the tool itself by providing a pressurized hydraulic fluid supply and an essentially atmospheric pressure dump chamber. Such an approach is seen in U.S. Pat. No. 4,375,239 to Barrington et al.

There are limitations inherent in many of these designs. Those tools which use either a high pressure source or low pressure reference defined by a fixed volume within the tool itself are typically limited in the number of operating strokes they can provide since they either run out of pressurized high pressure fluid, or run out of space in the low pressure reference zone.

Those systems like the Beck U.S. Pat. No. 4,422,506 which utilize a time delay in communication of well annulus pressure changes to one side of the piston can provide an unlimited number of operating strokes in many cases, but they do have the inherent drawback of the time delays which are necessary between operating strokes.

The prior art also includes tools which have operated in response to a pressure differential between a well annulus and the interior of a tubing string, but these tools have not been capable of repeated operation. Examples of such tools are found in U.S. Pat. No. 3,779,263 to Edwards et al.

SUMMARY OF THE INVENTION

The present invention provides a downhole tool operating system which utilizes a pressure differential between the well annulus, and another zone of the well isolated from the well annulus, typically the tubing string bore, as an endless power source to move the downhole tool through an unlimited number of operating cycles.

The downhole tool apparatus includes a housing having a power chamber and first and second isolation chambers defined therein. A power transfer element, such as a power piston is disposed in the power chamber. The power piston divides the power chamber into first and second power chamber portions.

A first isolation piston is slidably disposed in the first isolation chamber and divides the first isolation chamber into a first tool side chamber portion and a first well side chamber portion. A second isolation piston is slidably disposed in the second isolation chamber and divides the second isolation chamber into a second tool side chamber portion and a second well side chamber portion.

A reversing valve has a first position for communicating a high pressure zone of the well, typically the well annulus, with the first well side chamber portion while simultaneously communicating a low pressure zone of the well, typically the tubing string bore, with the second well side chamber portion. The reversing valve has a second position wherein the relationship between the high and low pressure sources with the well side chamber portions of the first and second isolation chambers are reversed.

An operating valve communicates one of the first and second tool side chamber portions with a selected one of the first and second power chamber portions while simultaneously communicating the other of the first and second tool side chamber portions with the other of the first and second power chamber portions.

Thus, the high pressure source, typically the well annulus, can be communicated an unlimited number of times with one side of the power piston while communicating the other side thereof with the low pressure source, typically the tubing string bore. The high pressure is transmitted through one of the isolation chambers until such time as the hydraulic fluid on the tool side chamber portion thereof is substantially exhausted, at which point the directions of the isolation pistons are reversed and the high pressure is then transmitted through the other isolation chamber.

The movement of the operating valve to direct high pressure fluid to the selected side of the power piston is typically controlled in response to command signals transmitted from a surface location adjacent the well.

The invention is also useful with rotating power transfer elements such as a hydraulic motor or a turbine wheel.

Thus a system is provided where all of the energy for movement of the power transfer element comes from a pressure differential which exists in the well and is of unlimited capacity. Thus there is no limitation on the number of operating cycles which can be performed by the tool.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 6 is a schematic illustration of another embodiment of the invention utilizing a pilot valve controlled by the electronic control package to control the operation of the reversing valve.

DETAILED DESCRIPTION OF THE PREFERRED EMBODIMENTS

The Background Environment of the Invention

It is appropriate at this point to provide a description of the environment in which the present invention is used. During the course of drilling an oil well, the bore hole is filled with a fluid known as drilling fluid or drilling mud. One of the purposes of this drilling fluid is to contain in intersected formations any formation fluid which may be found there. To contain these formation fluids the drilling mud is weighted with various additives so that the hydrostatic pressure of the mud at the formation depth is sufficient to maintain the formation fluid within the formation without allowing it to escape into the borehole. Drilling fluids and formation fluids can all be generally referred to as well fluids.

When it is desired to test the production capabilities of the formation, a testing string is lowered into the borehole to the formation depth and the formation fluid is allowed to flow into the string in a controlled testing program.

Sometimes, lower pressure is maintained in the interior of the testing string as it is lowered into the borehole. This is usually done by keeping a formation tester valve in the closed position near the lower end of the testing string. When the testing depth is reached, a packer is set to seal the borehole, thus closing the formation from the hydrostatic pressure of the drilling fluid in the well annulus. The formation tester valve at the lower end of the testing string is then opened and the formation fluid, free from the restraining pressure of the drilling fluid, can flow into the interior of the testing string.

At other times the conditions are such that it is desirable to fill the testing string above the formation tester valve with liquid as the testing string is lowered into the well. This may be for the purpose of equalizing the hydrostatic pressure head across the walls of the test string to prevent inward collapse of the pipe and/or may be for the purpose of permitting pressure testing of the test string as it is lowered into the well.

The well testing program includes intervals of formation flow and intervals when the formation is closed in. Pressure recordings are taken throughout the program for later analysis to determine the production capability of the formation. If desired, a sample of the formation fluid may be caught in a suitable sample chamber.

At the end of the well testing program, a circulation valve in the test string is opened, formation fluid in the testing string is circulated out, the packer is released, and the testing string is withdrawn.

Figure 1:
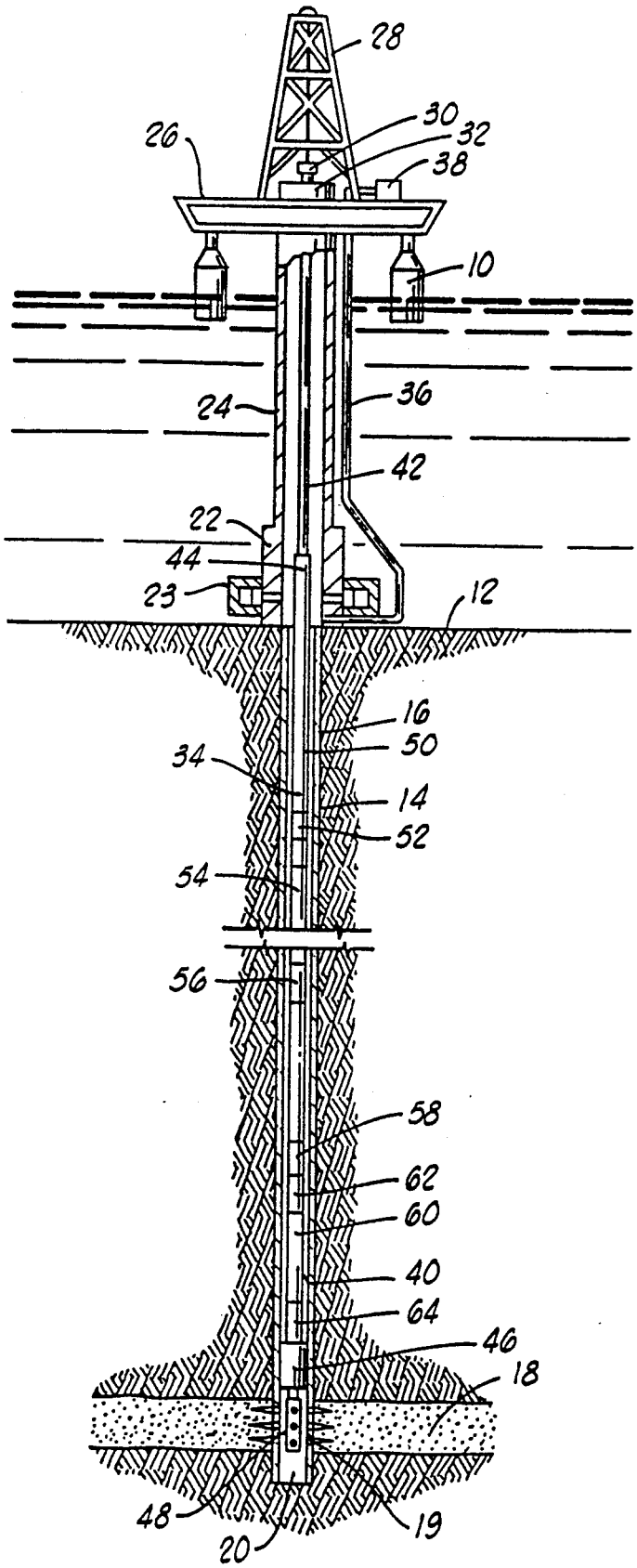
FIG. 1 is an elevation schematic view of a typical well test string in which the present invention may be incorporated.

A typical arrangement for conducting a drill stem test offshore is shown in FIG. 1. Of course, the apparatus and methods of the present invention may also be used on wells located onshore.

The arrangement of the offshore system includes a floating work station 10 stationed over a submerged work site 12. The well comprises a well bore 14, which typically is lined with a casing string 16 extending from the work site 12 to a submerged formation 18. It will be appreciated, however, that the methods and apparatus of the present invention can also be used to test a well which has not yet had the casing set therein.

The casing string includes a plurality of perforations 19 at its lower end which provide communication between the formation 18 and a lower interior zone or annulus 20 of the well bore 14.

At the submerged well site 12 is located the well head installation 22 which includes blowout preventer mechanisms 23. A marine conductor 24 extends from the well head installation 22 to the floating work station 10. The floating work station 10 includes a work deck 26 which supports a derrick 28. The derrick 28 supports a hoisting means 30. A well head closure 32 is provided at the upper end of the marine conductor 24. The well head closure 32 allows for lowering into the marine conductor and into the well bore 14 a formation testing string 34 which is raised and lowered in the well by the hoisting means 30. The testing string 34 may also generally be referred to as a tubing string 34.

A supply conduit 36 is provided which extends from a hydraulic pump 38 on the deck 26 of the floating station 10 and extends to the well head installation 22 at a point below the blowout preventer 23 to allow the pressurizing of the well annulus 40 defined between the testing string 34 and the well bore 14.

The testing string 34 includes an upper conduit string portion 42 extending from the work deck 26 to the well head installation 22. A subsea test tree 44 is located at the lower end of the upper conduit string 42 and is landed in the well head installation 22.

The lower portion of the formation testing string 34 extends from the test tree 44 to the formation 18. A packer mechanism 46 isolates the formation 18 from fluids in the well annulus 40. Thus, an interior or tubing string bore of the tubing string 34 is isolated from the upper well annulus 40 above packer 46. Also, the upper well annulus 40 above packer 46 is isolated from the lower zone 20 of the well which is often referred to as the rat hole 20.

A perforated tail piece 48 provided at the lower end of the testing string 34 allows fluid communication between the formation 18 and the interior of the tubular formation testing string 34 through lower zone 20.

The lower portion of the formation testing string 34 further includes intermediate conduit portion 50 and torque transmitting pressure and volume balanced slip joint means 52. An intermediate conduit portion 54 is provided for imparting packer setting weight to the packer mechanism 46 at the lower end of the string.

It is many times desirable to place near the lower end of the testing string 34 a circulation valve 56 which may be opened by rotation or reciprocation of the testing string or a combination of both or by dropping of a weighted bar in the interior of the testing string 34. Below circulating valve 56 there may be located a combination sampler valve section and reverse circulation valve 58.

Also near the lower end of the formation testing string 34 is located a formation tester valve 60. Immediately above the formation tester valve 60 there may be located a drill pipe tester valve 62.

A pressure recording device 64 is located below the formation tester valve 60. The pressure recording device 64 is preferably one which provides a full opening passageway through the center of the pressure recorder to provide a full opening passageway through the entire length of the formation testing string.

The present invention relates to a system for actuating various ones of the tools found in such a testing string 34, and relates to novel constructions of such tools designed for use with this new actuating system. Typical examples of the tools to which this new actuating system may be applied would be the formation tester valve 60 and/or the reverse circulating valve 56.

Figure 2:
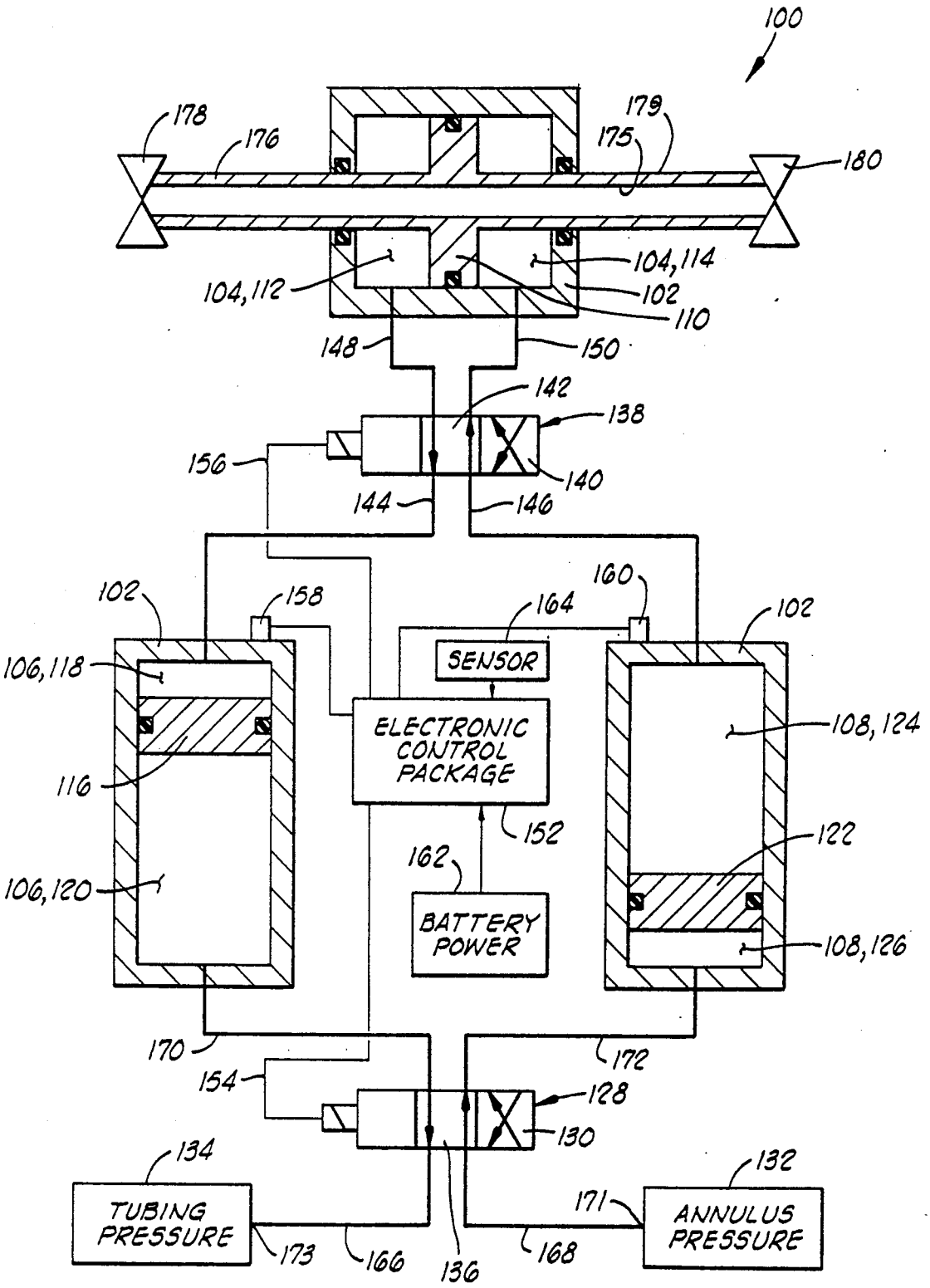
FIG. 2 is a schematic illustration of a first embodiment of the differential actuating system of the present invention. In this embodiment, the position of the reversing valve and the correlation between the reversing valve and the operating valve is controlled electronically with a microprocessor.

The Embodiment of FIG. 2

FIG. 2 schematically illustrates one embodiment of a downhole tool including the differential pressure actuation system of the present invention.

In FIG. 2 a downhole tool apparatus is shown schematically and is generally designated by the numeral 100. The downhole tool apparatus 100 is a tool for use in a well such as that previously described with regard to FIG. 1. The downhole tool 100, may for example, be a formation tester valve in the location shown as 60 in FIG. 1 or a circulating valve in the location shown as 56 in FIG. 1. The differential pressure actuation system of the present invention could also be used with other ones of the tools shown in the tool string in FIG. 1.

The tool 100 includes a housing generally designated as 102. Since FIG. 2 is a schematic illustration, various portions of the housing 102 are shown in disjointed locations in FIG. 2. It will be understood, however, that in any given physical embodiment of the tool 100, the various portions of the housing 102 will all be connected together.

The housing 102 has a power chamber 104 and first and second isolation chambers 106 and 108 defined therein.

A power piston 110, which may be more generally described as a power transfer element, is slidably disposed in the power chamber 104 and divides the power chamber 104 into first and second power chamber portions 112 and 114, respectively.

A first isolation piston 116 is slidably disposed in first isolation chamber 106 and divides the first isolation chamber 106 into a first tool side chamber portion 118 and a first well side chamber portion 120. Similarly, a second isolation piston 122 is slidably disposed in the second isolation chamber 108 and divides the second isolation chamber 108 into a second tool side chamber portion 124 and a second well side chamber portion 126. The term "tool side" refers to the side of the subject structure which is in fluid flow communication with other internal portions of the tool 100 as contrasted to being in fluid flow communication with an external zone of the well, which is referred to as being a well side of the structure in question.

The apparatus 100 includes a reversing valve means 128 having a first position schematically indicated by the numeral 130 for communicating a high pressure zone 132 of the well of FIG. 1 with the first well side chamber portion 120 while simultaneously communicating a low pressure zone 134 of the well with the second well side chamber portion 126. Reversing valve means 128 has a second position schematically indicated by the numeral 136 in which the high pressure zone 132 is communicated with the second well side chamber portion 126 and the low pressure zone 134 is communicated with the first well side chamber portion 120.

The high pressure zone 132 of the well of FIG. 1 typically will be the upper well annulus 40 above the packer 46, and for that reason the well annulus will often hereafter be referred to as the well annulus 132. The low pressure zone 134 of the well of FIG. 1 will typically be the bore of tubing string 34 which most often will be communicated with and have a pressure equal to the rat hole 20. The bore of tubing string 34 can also be referred to as an interior zone of the tubing string 34.

It will be understood, however, that generally speaking other pressure differentials defined within the well could be utilized with the present invention. For example, high pressure could be applied to the tubing string bore in order to operate a tool on the differential between that high pressure and a lower pressure in the upper well annulus 40. Also if the tubing string bore is isolated from the rat hole 20, the rat hole 20 could be used as the low pressure zone and the tubing string bore as the high pressure zone.

As used herein, any reference to a low pressure zone of the well is not intended to include a low pressure zone defined entirely inside the tool, such as a substantially atmospheric dump chamber defined entirely in the tool. Such a zone defined entirely within the tool is considered not to be a zone of the well. A low pressure zone of the well can, however, be in fluid pressure communication with an interior zone of the tool and in that case the interior zone of the tool would be considered to be a part of the low pressure zone of the well.

The apparatus 100 further includes an operating valve means 138 for communicating one of the first and second tool side chamber portions 118 and 124 with a selected one of the first and second power chamber portions 112 and 114 while communicating the other of the first and second tool chamber portions 118 and 124 with the other of the first and second power chamber portions.

The operating valve means 138 has a first position schematically indicated by the numeral 140 which applies the pressure differential between the high and low pressure zones 132 and 134 in a first direction across the power piston 110, and a second position 142 which applies that pressure differential in the opposite direction across the power piston 110.

Passages 144 and 146 defined in the housing 102 communicate the first and second tool side chamber portions 118 and 124, respectively, with the operating valve means 138. Passages 148 and 150 defined in the housing 102 communicate the operating valve means 138 with the first and second power chamber portions 112 and 114, respectively.

Passages 148 and 150 can be described as reversible high pressure inlet and lower pressure outlet passages, since those two functions are repeatedly alternated or reversed between passages 148 and 150.

The first and second power chamber portions 112 and 114 and the first and second tool side chamber portions 118 and 124 along with the passages 144, 146, 148 and 150 are filled with a clean hydraulic fluid which flows between the power chamber 104 and the tool side chamber portions 118 and 124 through the operating valve means 138 as the power piston 110 moves back and forth within the power chamber 104. The isolation pistons 116 and 122 provide a means for isolating this clean hydraulic fluid from contamination or contact by well fluids in the high and low pressure zones 132 and 134 of the well which flow into and out of the well side chamber portions 120 and 126 of isolation chambers 106 and 108.

A microprocessor based electronic control package 152 is included in the apparatus 100. Reversing valve means 128 and operating valve means 138 are controlled by electric solenoids in response to signals from the control package 152 transmitted through electrical lines 154 and 156, respectively.

Position sensors 158 and 160 associated with the isolation chambers 106 and 108 transmits signals to the control package 152 when the isolation pistons 116 and 122, respectively, approach the upper end of their strokes.

It is also noted that instead of using position sensors 158 and 160, the control package 152 could keep track of the number of operating strokes of the power piston and calculate the appropriate time for reversing the reversing valve means 128.

The electronic control package 152 is powered by batteries or some other internal electrical power source 162. The power source could be a downhole power generator like that described below with reference to FIGS. 9 and 10, further details of which are set forth in co-pending U.S. patent application Ser. No. 07/658,478 now U.S. Pat. No. 5,149,984 of Schultz et al., entitled ELECTRIC POWER SUPPLY FOR USE DOWNHOLE, the details of which are incorporated herein by reference.

A remote sensor 164 receives command signals transmitted from a remote surface location adjacent the well of FIG. 1, e.g., on the work deck 26. The remote sensor 164 in association with the electronic control package 152 provides a remote control means for controlling the operating valve means 138 in response to the command signals transmitted from the surface location adjacent the well shown in FIG. 1.

Further, the electronic control package coordinates the operation of operating valve 138 with that of reversing valve 128 so that high pressure from the high pressure zone 132 is continuously transmitted through the operating valve means 138 to the selected high pressure side of the power piston 110.

The electronic control package 152 in association with the position sensors 158 and 160 can be generally described as a pressure supply control means operably associated with the reversing valve means 128 for switching the reversing valve means 128 alternately between its first and second positions 130 and 136 so that fluid pressure from the high pressure zone 132 is continuously communicated to the operating valve means 138.

The housing 102 has passages 166 and 168 defined therein for communicating the low and high pressure zones 132 and 134, respectively, with the reversing valve means 128. Also defined in housing 102 are passages 170 and 172 communicating the reversing valve means 128 with the well side chamber portions 120 and 126 of the isolation chambers 106 and 108. It will be appreciated that in a typical mechanical embodiment of the invention, the point of direct communication between a high pressure zone 132 such as the well annulus 40 with the passageway 168 will be an inlet power port 171 defined through and communicated with the outer surface of the housing 102. Similarly, the point of direct communication between the passage 166 and the low pressure zone 134, such as the bore of the tubing string 34 will be a low pressure discharge port 173 defined in the housing 102 and typically opening into a central housing bore 175 extending through the housing 102 and communicated with and making up a part of the tubing bore of the tubing string 34.

The various fluid passages 144, 146, 148, 150, 166, 168, 170 and 172 defined in housing 102 collectively can be defined as power passage means defined in the housing 102 for providing fluid pressure communication between the power chamber 104 and the high and low pressure zones 132 and 134 of the well. In any particular positions of the control valve 138, and reversing valve 128, particular ones of those passages will in fact provide high and low pressure transmission paths between the power chamber 104 and the high and low pressure zones 132 and 134 of the well.

The isolation chambers 106 and 108, the reversing valve 128 and the operating valve 138 along with the associated connecting passages and the electronic control package 152 can all be collectively referred to as a pressure transfer control means for applying a pressure differential between the high and low pressure zones 132 and 134 of the well across the power piston 110 to operate the tool 100.

This pressure transfer control means provides a means for applying the pressure differential between the high and low pressure zones 132 and 134 across the power piston 110 repeatedly in alternating directions to repeatedly operate the tool 100.

It will be understood that the power piston 110 is connected through an operating mechanism 176, to an operating element 178 such as a rotating ball valve or the like to move the same between an open and closed position. For example, if the apparatus 100 is a formation tester valve, the power piston 110 would be connected to a rotating ball valve operating element through an operating mechanism much like that disclosed in U.S. Pat. No. 3,856,085 to Holden et al., details of which are incorporated herein by reference.

Another example would be the use of apparatus 100 as a circulation valve in which case the power piston 110 would be connected to a sliding sleeve valve operating element in a fashion similar to that shown in U.S. Pat. No. 4,113,012 to Evans et al., the details of which are incorporated herein by reference. Preferably the indexing system of the Evans et al. tool would be deleted.

Also a multi-mode operating element could be used substantially like that shown in U.S. Pat. No. 4,711,305 to Ringgenberg, the details of which are incorporated herein by reference.

In addition to use as a tester valve or circulating valve, the system of the present invention can also be used on any type of downhole tool requiring an actuator or power transfer element such as a power piston 110 and the operating element 100 could be an equalizing valve, a packer, a sampler, a safety valve, a tubing tester valve, or a tubing conveyed perforation firing head or gun release among other possibilities. Furthermore, the power transfer element can be a rotating element of a hydraulic motor or turbine as described below with regard to FIGS. 9 and 10.

If the operating element 178 is a formation tester valve, then typically the high pressure zone 132 of the well will be the upper well annulus 40, and the low pressure zone 134 of the well will be the pressure in the rat hole 20 below the packer means 46 which typically will be communicated up through the lower end of the tubing string into the tubing string bore 175 within the apparatus 100 below the location of the tester valve element 178. The pressure differential could also, however, in this case be defined between the well annulus 40 and the tubing string bore above the formation tester valve 178.

If the operating element 178 is a circulating valve, then it will of course be necessary for the low pressure reference zone 134 to be the rat hole 20. This can be accomplished in a circulating valve by having the tubing string bore below the circulating valve open to the rat hole 20, and by having in operative association with the sliding sleeve circulating valve a test string closure valve 180 located therebelow operating by actuating mechanism 179. The test string closure valve 180 could be a rotating ball valve, and the operating mechanism 179 would be similar to that disclosed in U.S. Pat. No. 3,856,085 to Holden et al., the details of which are incorporated herein by reference.

The circulating valve would normally be in a closed position, and the test string closure valve located therebelow would normally be open. The high pressure zone 132 would be the well annulus exterior of the tubing string, and the low pressure zone 134 would be the pressure within the tubing string. The communication port 173 for the low pressure zone 134 would be below the test string closure valve 180.

When the signal is transmitted to the sensor 164 to cause the electronic control package 152 to cause the operating piston 110 to be moved to a position corresponding to an open position of the circulating valve operating element 178, the mechanical operating mechanism 179 between power piston 110 and the test string closure valve 180 would function to close the test string closure valve 180 before the sliding sleeve circulating valve element 178 opens. Thus, the low pressure reference 134 would continue to be the tubing string pressure below the closed valve 180 in spite of the fact that the upper portion of the tubing string bore would then be in fluid pressure communication with the well annulus through the open circulating valve 178. In reverse fashion, when it is time to reclose the sliding sleeve circulating valve element 178, the mechanical operating mechanism 179 would reopen the test string closure valve 180 after the circulating valve operating element 178 is reclosed.

Figure 3:
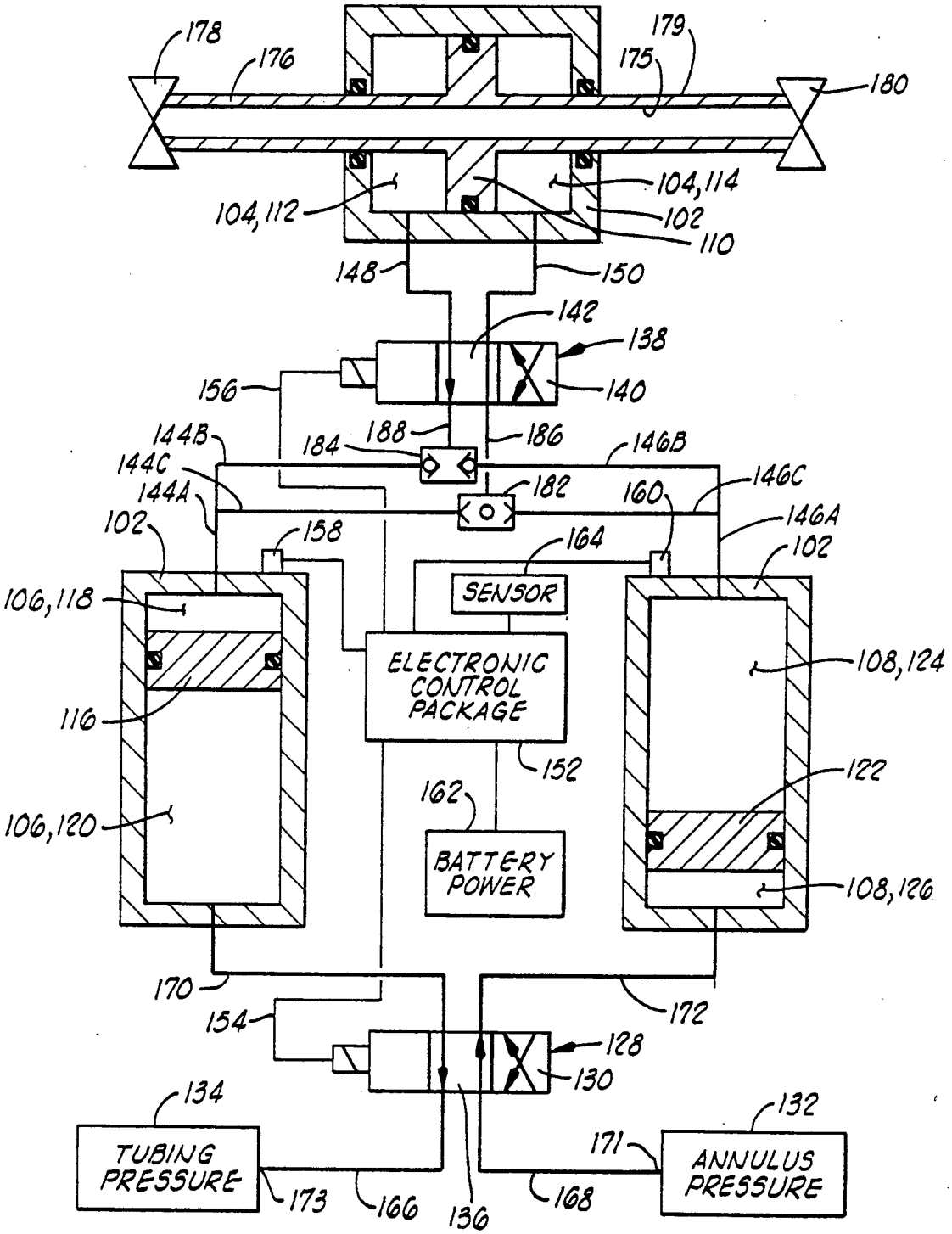
FIG 3 is a schematic illustration of an alternative embodiment of the invention. In the embodiment of FIG. 3, shuttle valves have been added so that the high and low pressure inlets to the operating valve remained fixed.

The Embodiment of FIG. 3

FIG. 3 shows a slightly modified version of the tool 100 of FIG. 2. The passages 144 and 146 of FIG. 2 which communicate the first and second tool side chamber portions 118 and 124 with the operating valve means 138 have been modified to allow the placement of a high pressure shuttle check valve means 182 and a low pressure shuttle check valve mean 184 into the system.

With the system of FIG. 2, the high pressure would not always enter the operating valve 138 at the same location. Since the two isolation chambers 106 and 108 alternate as the path for high pressure transmission, the inlet for high fluid pressure to the operating valve 138 would alternate between the lines 144 and 146. To accommodate that, the electronic control package 152 of FIG. 2 has to be programmed to correlate the operation of operating valve 138 and reversing valve 128. That is, the electronic control package 152 must know which position the reversing valve 128 is in so that it can properly instruct the operating valve 138 to choose the proper position to direct high pressure fluid to the appropriate side of the power piston 110.

With the modification of FIG. 3, the operating valve means 138 has a fixed high pressure inlet line 186 and a fixed low pressure outlet line 188.

The passage 144 from the first tool side chamber portion 118 has been modified so that it now has a common passage portion 144A which then branches into parallel passage portions 144B and 144C leading to the low pressure shuttle check valve means 184 and the high pressure shuttle check valve means 182, respectively. Similarly, the passage 146 from the second tool side chamber portion 124 now has a common portion 146A which branches into parallel portions 146B and 146C leading to the low and high pressure shuttle check valves 184 and 182. The fixed high pressure inlet line 186 leads from the high pressure check valve means 182 to the operating valve means 138. The fixed low pressure outlet line 188 leads from the low pressure shuttle check valve means 184 to the operating valve means 138.

The high pressure shuttle check valve means 182 automatically communicates the fixed high pressure inlet line 186 with the one of the isolation chambers 106 and 108 which happens to be communicated with the high pressure well zone 132. Similarly, the low pressure shuttle check valve means 184 will automatically communicate the fixed low pressure outlet line 188 with the other of the isolation chambers 106 and 108 which happens at that time to be communicated with the low pressure well zone 134.

Also, in the embodiment of FIG. 3, the electronic control package 152 need no longer correlate the operation of the operating valve 138 with that of the reversing valve 128, since the position of the high pressure supply 186 and the low pressure outlet 188 is now fixed by the operation of the shuttle valves 182 and 184.

Figure 4:
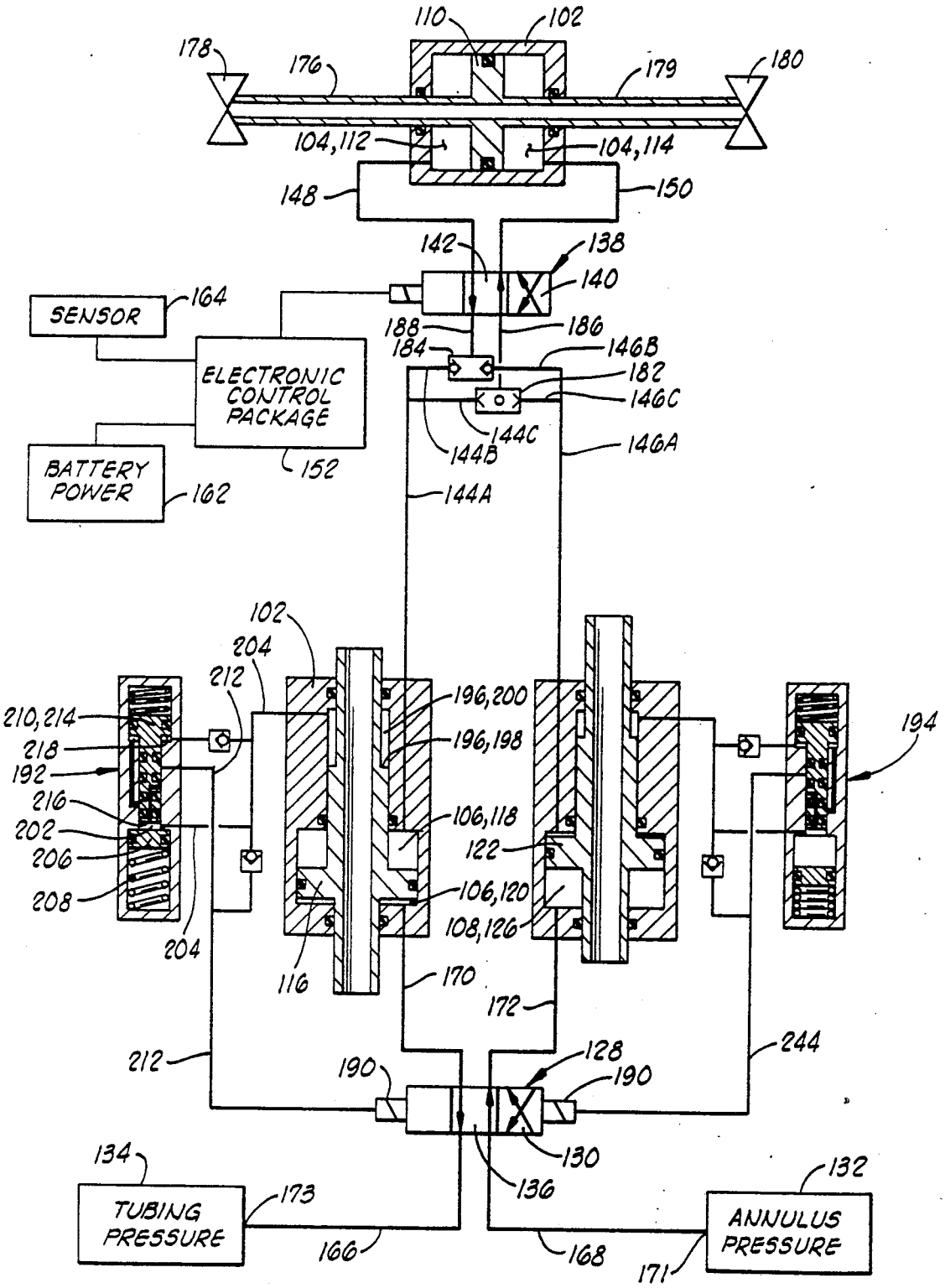
FIG. 4 is a schematic illustration of another embodiment of the invention in which a hydraulic position sensing system controls the operation of the reversing valve thus eliminating the need for any electronic control of the reversing valve.

The Embodiment of FIG. 4

FIG. 4 schematically illustrates a further modification of the system of FIGS. 2 and 3. The system of FIG. 4 includes the shuttle valves of FIG. 3. In FIG. 4, an additional modification is provided which completely eliminates the need for any interconnection between the electronic control package 152 and the reversing valve 128.

In the embodiment of FIG. 4, the reversing valve 128 has been modified to include a hydraulic actuator means 190 for moving the reversing valve means 128 between its first position 130 and second position 136. Also, first and second fluid accumulator means 192 and 194 are provided for sensing a position of the isolation pistons 116 and 122 and for directing pressurized hydraulic fluid to the hydraulic actuator means 190 of the reversing valve means 128 to switch the position of the reversing valve means 128 when the isolation pistons 116 and 122 near an end of their stroke within the isolation chambers 106 and 108.

In FIG. 4, the isolation chambers 106 and 108 and the isolation pistons 116 and 122 contained therein have been modified somewhat to accommodate the addition of the fluid accumulators 192 and 194. Components analogous to those of the systems of FIGS. 2 and 3, such as the isolation pistons 116 and 122, are still designated by the same numerals, although they are illustrated somewhat differently in the drawing.

The fluid accumulators 192 and 194 can each generally be described as a position sensing apparatus for sensing a position of a structure, such as the isolation piston 116, relative to a base, such as the housing 102.

The first isolation piston 116 now has associated therewith a displacement means 196 comprised of a differential area 198 defined upon an extension of the piston 116, and a displacement chamber 200 defined within the housing 102. As the isolation piston 116 moves within the isolation chamber 106 the volume of displacement chamber 200 changes so that hydraulic fluid is displaced from or enters the displacement chamber 200.

Figure 5:
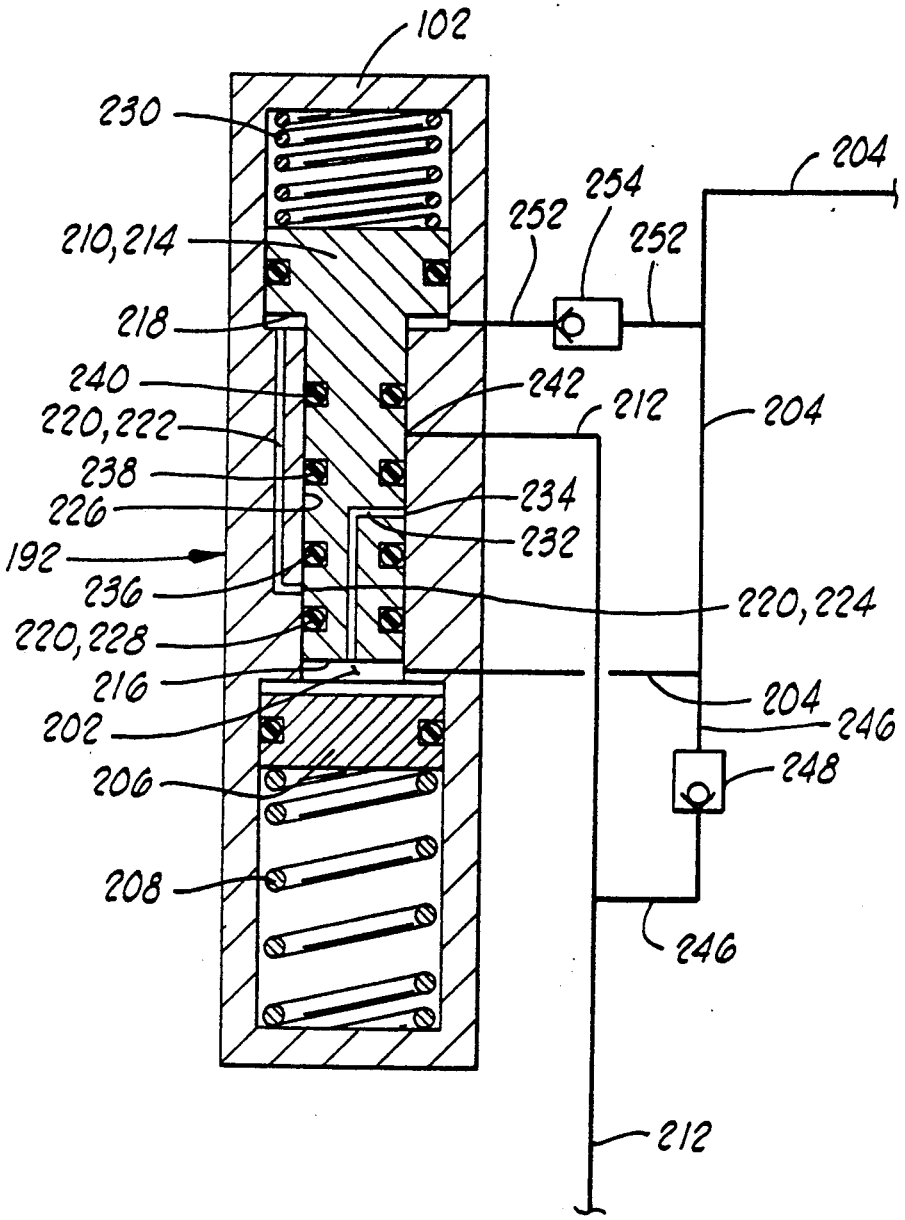
FIG. 5 is an enlarged view of one of the fluid accumulators of FIG. 4.
Figure 5:
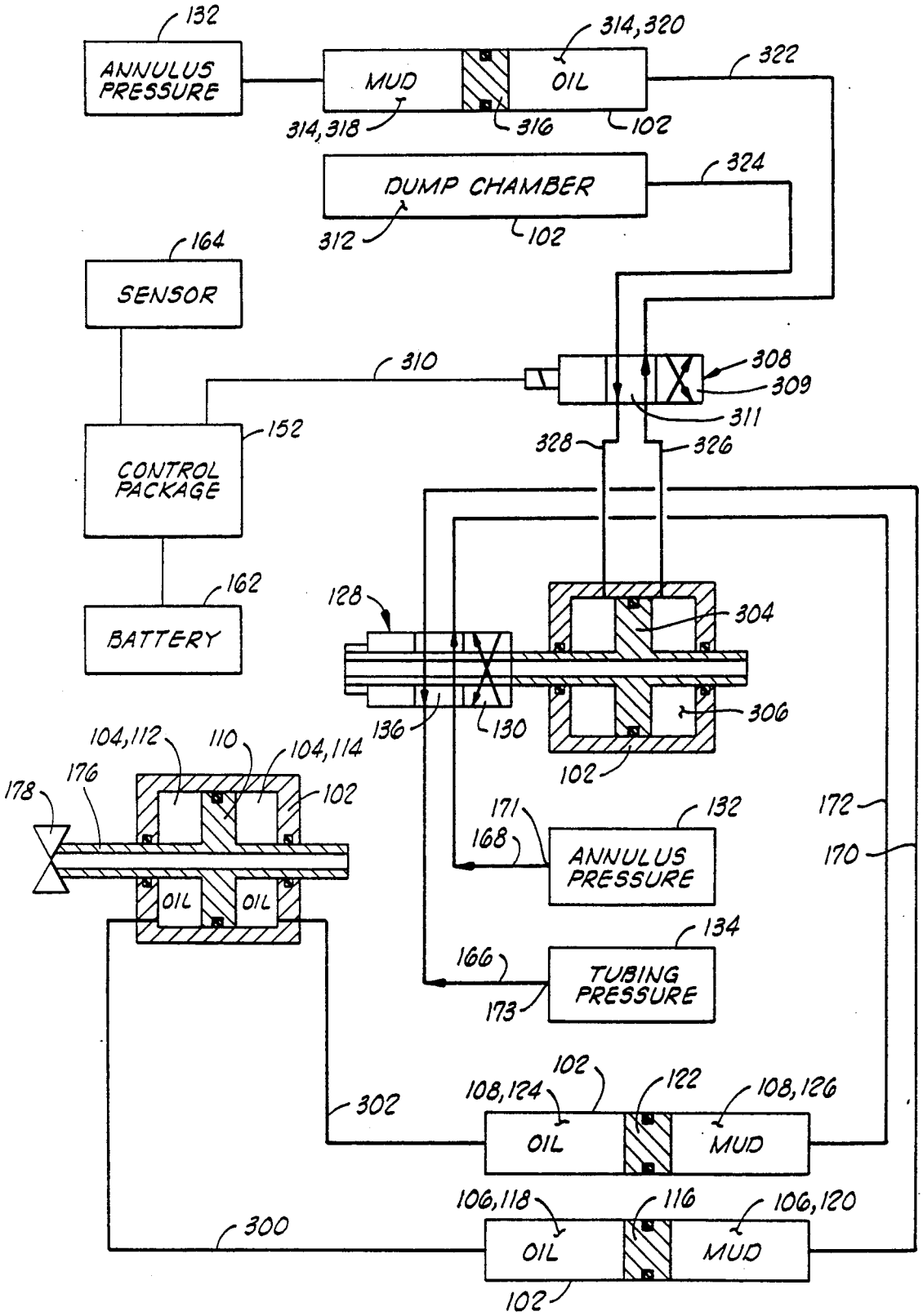

The hydraulic accumulator means 192, which is best seen in the enlarged view of FIG. 5, includes an accumulator chamber 202 for accumulating an increasing volume of hydraulic fluid from the displacement means 196 at a pressure increasing in relation to the increasing volume. The accumulator chamber 202 is communicated with the displacement means 196 by passage 204 defined in the housing 102.

The accumulator means 192 includes an accumulator piston 206 slidably received within a bore defining the circumference of the accumulator chamber 202. The top surface of accumulator piston 206 as seen in FIG. 4 defines a movable surface of the accumulator chamber 202. A coil biasing spring 208 provides a means for biasing the accumulator piston 206 against the volume of hydraulic fluid in accumulator chamber 202 with a force that increases relative to the compression of the biasing spring 208.

In FIG. 4, the accumulator means 192 is shown with its accumulator piston 206 at its uppermost position corresponding to a minimum volume of the accumulator chamber 202. The isolation piston 116 in first isolation chamber 106 is shown near the lower end of its stroke, and the reversing valve means 128 is shown in its second position 136 so that the first isolation chamber 106 is serving as a path for low fluid pressures to be communicated to the low pressure zone 134.

When the reversing valve means 128 is switched to its first position 130 so that high fluid pressure from the high pressure zone 132 is then directed to the first well side chamber portion 120 of first isolation chamber 106, the displacement means 196 will begin to displace hydraulic fluid out of displacement chamber 200 as the isolation piston 116 moves upward. That displaced fluid will flow into the accumulator chamber 202 of first accumulator means 192 and gradually the biasing spring 208 will be compressed as the accumulator piston 206 moves downward to accommodate the increasing volume of fluid within accumulator chamber 202. As the volume of fluid contained in chamber 202 increases, the pressure of that fluid will be increased due to increasing compression of biasing spring 208.

The first fluid accumulator means 192 also includes a dump valve means 210 in fluid flow communication with the accumulator chamber 202 for discharging at least a portion of the volume of hydraulic fluid which accumulates in chamber 202 into a discharge passage or conduit 212 when the pressure of the hydraulic fluid contained in chamber 202 reaches a predetermined level which is dependent upon the design and construction of the dump valve means 210 which is further described below.

The dump valve means 210 includes a two-stage dump piston 214 having first and second differential areas 216 and 218, respectively, defined thereon. The first differential area 216 is in continuous communication with and defines an upper wall of the accumulator chamber 202.

The first fluid accumulator means 192 further includes a pilot valve means 220 defined on and associated with the dump piston 214. The pilot valve means 220 includes a pilot valve passage 222 communicating the second differential area 218 with a pilot valve port 224 which opens to a bore 226 in which the smaller diameter part of the two-stage dump piston 214 is slidably received. In FIG. 5 the pilot valve means 220 is shown in a closed position wherein an O-ring seal 228 of pilot valve means 220 isolates the pilot valve port 224 from the accumulator chamber 202.

The dump valve means 210 further includes a resilient compression spring biasing means 230 for biasing the dump piston 21 toward the accumulator chamber 202.

As the pressure of hydraulic fluid contained in accumulator chamber 202 increases the dump piston 214 will move upward and gradually compress the spring 230. At a predetermined pressure within the chamber 202 which is determined by the spring rate of the spring 230 the O-ring 228 will move upward above the pilot valve port 224 thus defining an open position of the pilot valve means 220 in which the accumulator chamber 202 is communicated with the second differential area 218.

When the O-ring 228 moves upward across the pilot valve port 224, a portion of the hydraulic fluid in accumulator chamber 202 will rapidly flow through the pilot valve passage 218 and will contact the second differential area 218. The spring rate of the spring 230 is such that the force from this fluid acting across the second differential area 218 will rapidly further compress the spring 230 allowing the dump piston 214 to rapidly move or jump up to a fully open position wherein fluid from the accumulator chamber 202 will be allowed to flow into the discharge passage 212.

It is noted that the mechanical springs 208 and 230 which are illustrated could be replaced by compressed gas springs such as a sealed chamber filled with nitrogen gas.

The accumulator piston 214 has an internal piston discharge passsage 232 which communicates the lower end 216 thereof with a port 234 located between O-rings 236 and 238 carried by the dump piston 214. The dump piston 214 also carries another O-ring 240.

When the dump piston 214 is in its initial position as seen in FIG. 5, the O-ring 238 separates the port 234 from a port 242 associated with discharge passage 212. The ports 234 and 242 remain separated from each other by O-ring 238 until after the pilot valve means 220 has opened. When the dump piston 214 moves upward to its fully open position, the O-rings 236 and 238 will be on either side of port 242 and the ports 234 and 242 will be in alignment thus providing open flow communication through passage 232 into discharge passage 212 for the pressurized hydraulic fluid contained in accumulator chamber 202. That pressurized hydraulic fluid will flow through the discharge passage 212 to the hydraulic actuator means 190 associated with reversing valve means 128 to move the reversing valve means 128 between its first and second positions 130 and 136.

The first hydraulic accumulator means 192 is shown in FIGS. 4 and 5 in an initial position thereof prior to or at the beginning of upward movement of its associated isolation piston 116. The second hydraulic accumulator means 194, on the other hand, is shown in a position as it would be in as its associated isolation piston 122 nears the upper end of its stroke within the second accumulator chamber 108, just prior to the opening of its pilot valve means and the discharge of fluid from its accumulator chamber to a discharge passage 244 communicated with the hydraulic actuator means 190 to move the reversing valve means 128 from its second position 136 to its first position 130.

When the isolation piston 116 is on its downward stroke as represented in FIGS. 4 and 5, it is necessary for hydraulic fluid which had previously been directed to the hydraulic actuator means 190 and to a lesser extent to the second differential area 218, to return to the displacement chamber 200. The return of fluid from the hydraulic actuator means 190 is accomplished back through the discharge passage 212 and through a primary return passage 246 which communicates discharge passage 212 with the passage 204. A check valve 248 is disposed in primary return passage 246 to permit flow only from discharge passage 212 to the passage 204 and not vice versa. Any fluid trapped under the second differential are 218 of dump piston 214 can return through a secondary return passage 252 which has a check valve 254 disposed therein.

The Embodiment of FIG. 6

FIG. 6 schematically illustrates another embodiment of the invention wherein there is no operating valve means 138 located between the isolation chambers and the power chamber, but instead the reversing valve means 128 is used as a means for controlling the operation of the power piston 110. Each time the reversing valve means 128 reverses its position, the pressure differential between the high pressure zone 132 and low pressure zone 134 is communicated directly to the power piston 110 through the isolation chambers. Thus, the isolation pistons 116 and 122 change direction with each operating stroke of the power piston 110.

In the embodiment of FIG. 6, the housing 102 again has the power chamber 104 and first and second isolation chambers 106 and 108 defined therein. The power piston 110 is slidably disposed in the power chamber 104 as previously described.

The first and second isolation pistons 116 and 122 are slidably disposed in the first and second isolation chambers 106 and 108 as previously described. In this embodiment, however, the volume of the isolation chambers 106 and 108 will be very much less than that which would be utilized with the embodiments of FIGS. 2, 3 or 4, since the isolation chambers of FIG. 6 need only accommodate a single operating stroke of the power piston 110, since they reverse direction with each stroke of the power piston 110.

First and second conduit means 300 and 302 are defined in the housing 102 for communicating the first and second tool side chamber portions 118 and 124 of the first and second isolation chambers 106 and 108 with the power chamber 104.

The reversing valve means 128 again has a first position 130 which communicates the high pressure zone 132 with the first well side chamber portion 120 while simultaneously communicating the low pressure zone 134 with the second well side chamber portion 126. Reversing valve means 128 also has a second position 136 which is illustrated in FIG. 6, wherein the high pressure zone 132 is communicated with the second well side chamber portion 126 while simultaneously communicating the low pressure zone 134 with the first well side chamber portion 120.

In the embodiment of FIG. 6, the reversing valve means 128 can also be described as a main operating valve means 128 for directly controlling fluid pressure communication between the power piston 110 and each of the well annulus 132 and low pressure zone 134.

The apparatus of FIG. 6 further includes a differential pressure actuating piston means 304 operably connected to the reversing valve means 128 for moving the reversing valve means 128 between its first and second positions 130 and 136. The differential pressure actuating piston means 304 is disposed in an actuating chamber 306 defined within the housing 102.

A pilot valve means 308 is provided for selectively applying a second fluid pressure differential across the differential pressure actuating piston means 304 to move the actuating piston means 304 and thus move the reversing valve 128 between its first and second positions 130 and 136. Pilot valve means 308 has first and second positions 309 and 311. The pilot valve means 308 is an electrically operated solenoid valve controlled by the control package 152 which transmits control signals through electrical connecting means 310.

In the embodiment of FIG. 6, the housing 102 has a substantially atmospheric pressure dump chamber 312 defined therein, along with a third isolation chamber 314. A third isolation piston 316 is slidably received in the third isolation chamber 314 and separates well fluids from the well annulus 132 which is communicated with a third well side chamber portion 318 thereof, from clean hydraulic fluid in the third tool side chamber portion 320 thereof.

Passages 322 and 324 communicate the third isolation chamber 314 and the dump chamber 312 with the pilot valve means 308. Passages 326 and 328 communicate the pilot valve means 308 with the actuating chamber 306.

Thus, the second fluid pressure differential which is used to move the differential pressure actuating piston means 304 is the differential between well annulus pressure in the annulus 132 and the substantially atmospheric pressure in the dump chamber 312.

There are several advantages to the embodiment illustrated in FIG. 6.

Since the first and second isolation pistons 116 and 122 reverse their direction with each stroke of the power piston 110, the volume of the isolation chambers 106 and 108 in FIG. 6 is much less than the those of FIGS. 2, 3 and 4 which must accommodate multiple strokes of the power piston before reversal of direction of the isolation pistons.

Although the embodiment of FIG. 6 does not provide limitless operation, due to the limiting factor of the volume of oil contained in the third isolation chamber 314, the differential pressure actuating piston means 304 has a relatively small area as compared to the power piston 110, and thus relatively little hydraulic fluid is necessary for each stroke of the differential pressure actuating piston 304. Thus, many more operating cycles can be performed with the system of FIG. 6 than could be performed with a system wherein the pressure differential between the well annulus 132 and the dump chamber 312 were applied directly across the power piston 110.

Figure 7:
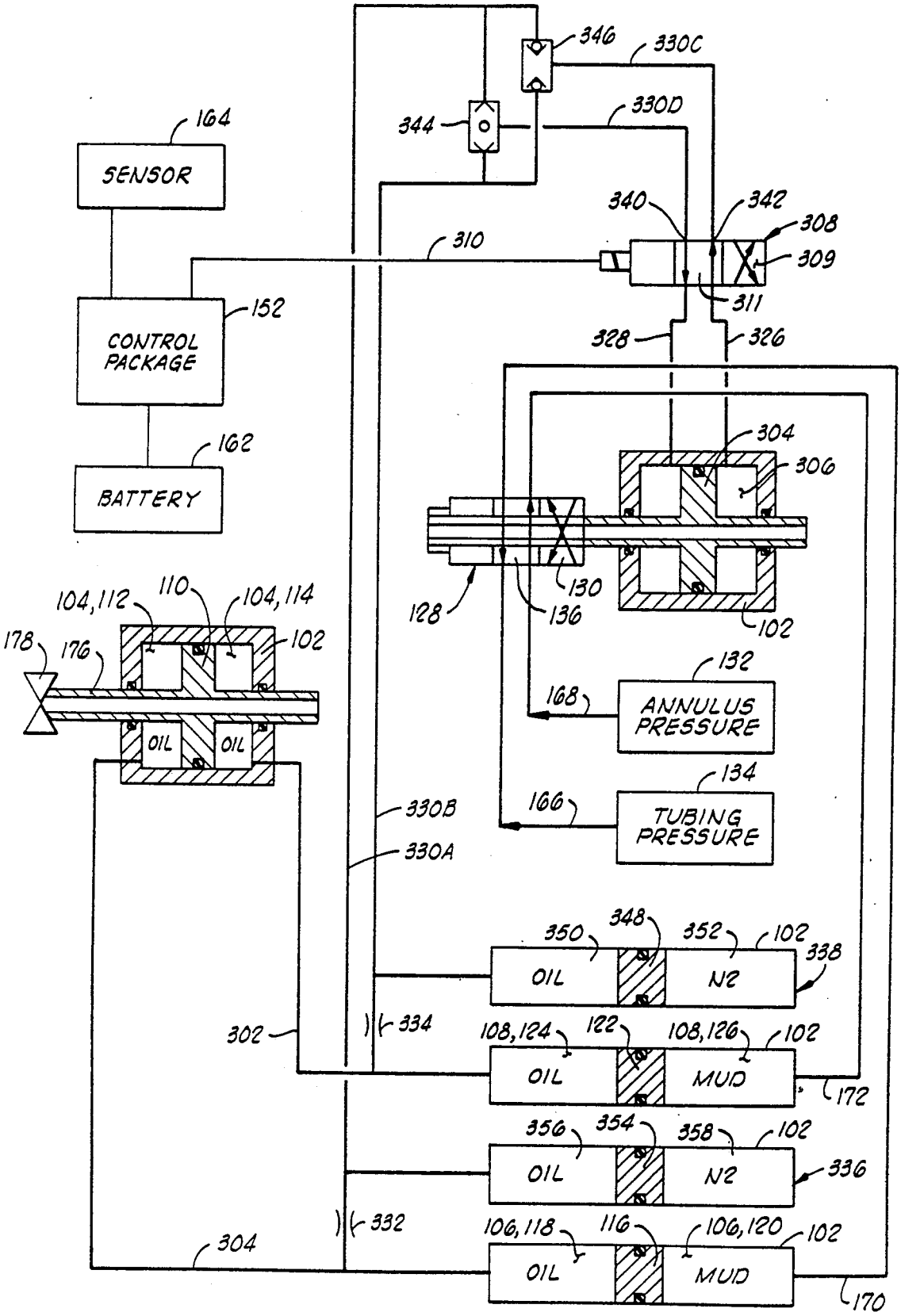
FIG. 7 is a schematic illustration of another alternative embodiment of the invention, again using a pilot valve arrangement like FIG. 6, but this time providing fluid power to the pilot valve from the high and low pressure zones defined in the well. The pilot valve is again controlled by the electronic control package.

The Embodiment of FIG. 7

The embodiment of FIG. 7 is somewhat similar to that of FIG. 6 just described in that the power piston 110 is directly controlled by reversal of the reversing valve means 128 which communicates the differential between well annulus 132 and the low pressure zone 134 directly through the isolation chambers 106 and 108 to the power chamber 104. Again, the reversing valve means 128 is controlled by a pilot valve means 308 which acts upon a differential pressure actuating piston 304.

In the embodiment of FIG. 7, however, the pressure differential controlled through the pilot valve means 308 which acts upon the differential pressure actuating piston means 304 is the pressure differential between the well annulus 132 and low pressure zone 134. This pressure differential is provided by a pressure differential supply conduit means 330 defined in the housing 102 for providing fluid pressure communication between the pilot valve means 308 and the passages 302 and 304 which are communicated with the high pressure zone 132 and low pressure zone 134. Thus, whatever pressure is present in the first and second isolation chambers 106 and 108 is communicated through the pressure differential supply conduit means 330 to the pilot valve means 308.

The pressure supply conduit means 330 is made up of several segments 330A, 330B, 330C and 330D.

First and second fluid flow restriction means 332 and 334 are disposed in the conduit segments 330A and 330B, respectively. The fluid flow restrictors 332 and 334 provide a time delay means for delaying communication to the pilot valve means 308 of pressure changes in the first and second isolation chambers 106 and 108, respectively.

Additionally, there are first and second fluid pressure accumulator means 336 and 338 connected to the conduit portions 330A and 330B, respectively, for maintaining a pressure between the pilot valve means 308 and the fluid flow restrictions 332 and 334 after the reversing valve means 128 begins to change position, for a sufficient time to complete a stroke of the differential pressure actuating means 304.

It is noted that the pilot valve means 308 has a fixed high pressure inlet 340 from the pressure differential supply conduit means 330 and a fixed low pressure outlet 342 to the pressure differential supply conduit means 330. A high pressure shuttle check valve means 344 is disposed in the pressure differential supply conduit means 330 for communicating the fixed high pressure inlet 340 with whichever one of the isolation chambers 106 and 108 is communicated with the high pressure zone 132. A low pressure shuttle check valve means 346 is disposed in the pressure differential supply conduit means 330 for communicating the fixed low pressure outlet 342 with whichever of the isolation chambers 106 and 108 is communicated with the low pressure zone 134.

Consider the system shown in FIG. 7 in a state in which the power piston 110 is at rest at the left-hand side of the power chamber 104 as it would be in the second position 136 of reversing valve means 128 as illustrated in FIG. 7. The operation of the system would then be as follows to move the power piston 110 from left to right.

First, with the power piston 110 at rest in its leftmost position, the high pressure zone 132 is communicated with the second isolation chamber 108 and the low pressure zone 134 is communicated with the first isolation chamber 106. After a sufficient period of time in this position, the high pressure in the second isolation chamber 108 communicates through the second fluid flow restriction 334 so that the same high pressure is present in conduit segments 330B and 330D. That same high pressure is also present in second fluid pressure accumulator 338.

Similarly, the low pressure from low pressure zone 134 is present in first isolation chamber 106, and conduit segments 330A and 330C, and in the first fluid pressure accumulator 336.

When it is desired to move the actuating piston 110 from left to right to operate the operating element 178, an appropriate command signal is transmitted from the surface and received by sensor 164. The control package 152 in response to that command signal directs the pilot valve means 308 to move from its second position 311 to its first position 309.

When the pilot valve means 308 moves to its second position 309, the high fluid pressure will be directed through passage 326 to the right-hand side of actuating chamber 306 and the low fluid pressure will be communicated through passage 328 to the left-hand side of actuating chamber 306 thus moving the actuating piston 304 from right to left as seen in FIG. 7 and thus moving the reversing valve means 128 from its second position 136 to its first position 130.

As the actuating piston 304 moves the reversing valve means 128 from its second position 136 toward its first position 130, there is somewhat of a "dead spot" between those two positions in which there is no clear communication of the high and low pressure zones 132 and 134 with either of the isolation chambers 106 and 108.

Due to the function of the fluid flow restrictors 332 and 334 and the fluid pressure accumulators 336 and 338, however, a time delay is provided during which the previously existing pressure is maintained in the pressure differential supply passage means 330 and is thus maintained through the pilot valve means 308 to the acutating piston 304. This is maintained for a sufficient period of time to allow the actuating piston 304 to move the reversing valve means 128 completely to its first position 130. The fluid pressure accumulators 336 and 338 help maintain this previously existing pressure.

The fluid pressure accumulator 338 has an accumulator piston 348 slidably disposed therein separating the accumulator into an oil chamber 350 and a nitrogen chamber 352. Similarly, the first fluid pressure accumulator 336 has an accumulator piston 354 therein defining an oil chamber 356 and a nitrogen chamber 358.

As the high fluid pressure which was present in conduit segment 330B starts dropping off due to the flow of fluid into the right-hand side of actuating chamber 306 and due to flow of fluid toward the isolation chamber 108 through the fluid flow restrictor 334, the nitrogen in compressed nitrogen chamber 352 will expand thus moving the accumulator piston 348 from right to left as seen in FIG. 7 thus forcing oil out of oil chamber 352 into the conduit section 330B to maintain the high fluid pressure therein for a time. The piston 354 of accumulator 336 will move from left to right to accommodate rising pressure.

Thus, the fluid flow restrictors 332 and 334 in combination with the fluid pressure accumulators 336 and 338 maintain a sufficient portion of the previously existing pressure differential to the pilot valve means 308 for a period of time sufficient to stroke the actuating piston means 304 upon reversal of position of the pilot valve means 308.

The movement of the actuating piston 30 changes the position of the reversing valve means 128 from its second position 136 to its first position 130 thus reversing the fluid pressure differential between the isolation chambers 106 and 108 thus causing the power piston 110 to move from left to right as seen in FIG. 7. After a relatively short time interval has passed, the reverse pressure differential in the isolation chambers 106 and 108 will equalize through the fluid flow restrictions 332 and 334 and into the fluid pressure accumulators 336 and 338 so that the system is now ready for another change in position.

Figure 8:
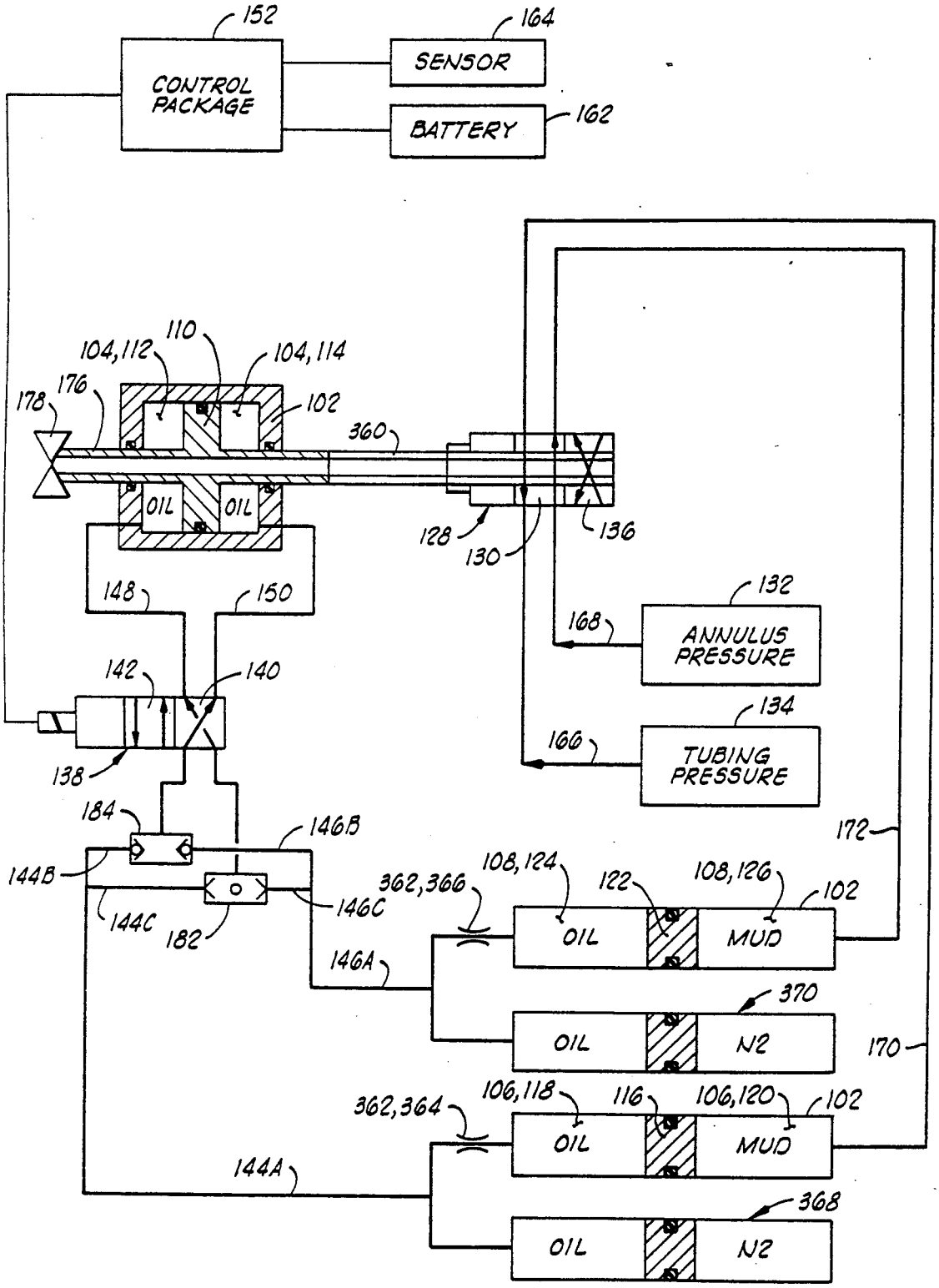
FIG. 8 is a schematic illustration of another embodiment of the invention in which the power piston is connected to the reversing valve so that the reversing valve is reversed with each stroke of the power piston.

The Embodiment of FIG. 8

In the embodiment of FIG. 8, the primary modification is that an actuating means 360 interconnects the power piston 110 with the reversing valve means 128 for changing the position of the reversing valve means 128 on each stroke of the power piston 110. Furthermore, to complement the interconnection of the power piston 110 and the reversing valve means 360, the isolation chambers 106 and 108 are greatly reduced in size as compared to those of FIGS. 2, 3 and 4 since they only need to accommodate a single stroke of a power piston 110. Additionally, time delay means 362 including first and second fluid flow restrictions 364 and 366 have been added downstream of the isolation chambers, along with fluid pressure accumulators 368 and 370.

Also, it is noted that in order to properly illustrate the interrelationship of the various components as they move through their operating cycles, the first and second positions previously described for the operating valve means 138 and the reversing valve means 128 do not correspond to the positions as schematically illustrated in FIGS. 2, 3 and 4. Those designations of first and second position means are of course simply for identification, and do not have any inherent meaning.

In FIG. 8, the apparatus is shown in what will be referred to as a first position, with the reversing valve means 128 in a first position 130 and the operating valve means 138 in a first position 140. In this position the high pressure from well annulus 132 is communicated through the second isolation chamber 108, then through the high pressure shuttle check valve means 182 and operating valve means 138 to the first power chamber portion 112 on the left side of the power piston 110. Similarly, the low pressure zone 134 is communicated through the first isolation chamber 106 with the second power chamber portion 114 on the right side of power piston 110, so that the power piston 110 is in a rightmost position within the power chamber 104 and is at rest. With the system at rest, the high pressure in second isolation chamber 108 equalizes through the fluid flow restriction 366 so that that high pressure is also stored in the second fluid pressure accumulator 370. Similarly, the low pressure in first isolation chamber 106 is equalized through the fluid flow restriction 364 and is present within the first fluid pressure accumulator 368.

When it is desired to move the power piston 110 from right to left to operate the operating element 178, a suitable command signal is received by sensor 164 and the control package 152 then directs the operating valve means 138 to move from its first position 140 to its second position 142. Immediately upon the change in position of operating valve means 138, the power piston 110 will begin to move from right to left, and this movement as communicated through the actuating means 360 will begin to move the reversing valve means 128 from its first position 130 to its second position 136.

As the reversing valve means 128 moves from its first position 130 toward its second position 136, the relative high and low pressures in the second isolation chamber 108 and first isolation chamber 106 will begin to reverse.

In order to make certain that the power piston 110 completes its stroke from right to left, the time delay means 362 made up of the fluid flow restrictors 364 and 366 delays communication to the power piston 110 of the pressure changes in the first and second isolation chambers 106 and 108. During that delay, the fluid pressure accumulators 368 and 370 help maintain the previously existing pressure differential across the power piston 110 after the reversing valve means 128 begins changing position for a sufficient time to complete the stroke of the power piston 110. After the power piston 110 comes to rest in its leftmost position, a short time interval will pass during which the pressures will again equalize through the fluid flow restrictions 364 and 366, and at that point the system will be ready for another stroke.

Figure 9:
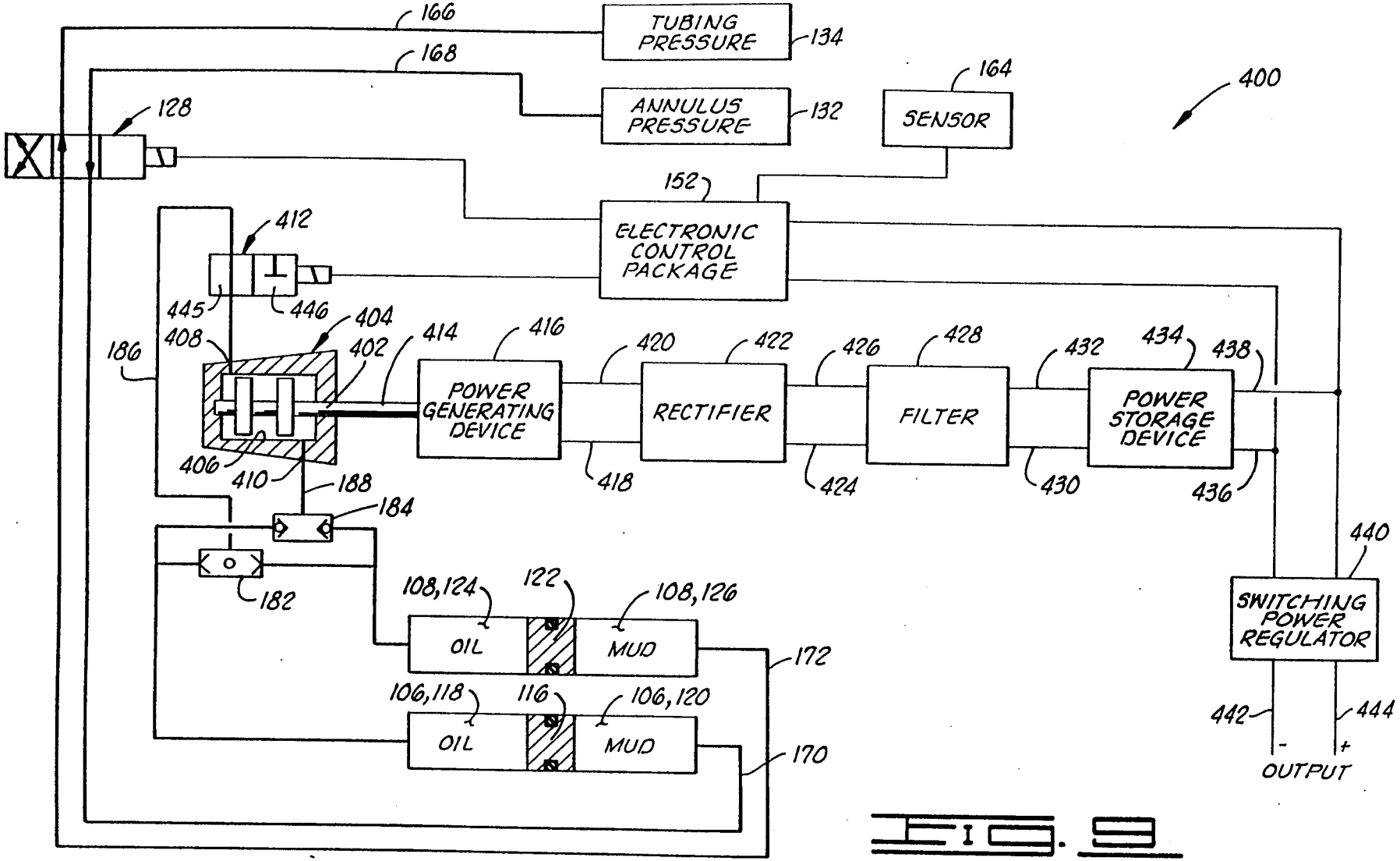
FIG. 9 is a schematic illustration of another embodiment of the invention showing its use in connection with a rotating power transfer element such as that within a hydraulic motor.

The Embodiment of FIG. 9

In FIG. 9 a downhole tool apparatus 400 is illustrated which has a rotating power transfer element 402.

The system 400 illustrated in FIG. 9 is actually a downhole power generating system which utilizes the pressure differential between annulus pressure 132 and tubing pressure 134 as a power source to turn the rotating power transfer element 402 of a hydraulic motor or hydraulic turbine 404 to generate electrical power downhole.

Those components of the system 400 which are closely analogous to the systems previously described are designated by the same numerals previously utilized. The hydraulic power supply plumbing of the embodiment of FIG. 9 is in many ways similar to that of FIG. 3.

The reversing valve means 128 as controlled by the microprocessor based electronic control package 152 controls the communication of the high pressure source 132 and low pressure zone 134 with the first and second isolation chambers 106 and 108.

The hydraulic motor 404 has a power chamber 406 defined therein within which the rotating power transfer element 402 is received. It will be understood that the power chamber 406 is only schematically illustrated, and represents the cavity in which rotating turbine blades would be received, or it can also schematically represent the cylinders of a piston type hydraulic motor. In any event, the hydraulic motor 404 will have a high pressure fluid inlet 408 and a low pressure fluid discharge 410 associated with its power chamber 406.

An on/off valve 412, the function of which is further described below, is located upstream of the high pressure fluid inlet 408 in the conduit 186. A high pressure shuttle check valve means 182 communicates whichever of the isolation chambers 106 and 108 that contains the higher pressure with the high pressure inlet 408. Similarly, the low pressure shuttle check valve means 184 communicates the low pressure fluid discharge 410 from the hydraulic motor 404 with whichever of the isolation chambers 106 and 108 that is at the lower pressure.

In normal operation it will be desirable to continuously rotate the rotating power transfer element 402 of hydraulic motor 404. To accommodate this, substantially all of the clean hydraulic fluid in the tool side chamber portion 118 of first isolation chamber 106 will be dispelled therefrom to the high pressure inlet 408 then through the power chamber 406 and out the low pressure discharge 410 into the tool side chamber portion 124 of the second isolation chamber 108. Periodically, the reversing valve means 128 will reverse so that the clean hydraulic fluid will then flow from the second isolation chamber 108 to the high pressure fluid inlet 408 then out the low pressure fluid discharge 410 into the tool side chamber portion 118 of the first isolation chamber 106. The microprocessor based electronic control package 152 can be programmed to control the reversing valve 128 so as to reverse it at the appropriate time. Thus, the clean hydraulic fluid contained in the tool side chamber portions 118 and 124 continuously flows back and forth therebetween, flowing through the power chamber 406 to substantially continuously turn the rotating power transfer element 402. Each revolution of the rotating power transfer element 402 can be considered to be an operating cycle of the rotating power transfer element 402 analogous to one reciprocation back and forth by the piston type power transfer element 110 of the earlier embodiments.

The rotating power transfer element 402 includes a rotating output shaft 414 which is connected to a power generating device 416 which in the embodiment disclosed generates an alternating current output across leads 418 and 420.

A rectifier 422 then provides either halfwave or fullwave rectification of the current across leads 418 and 420, and a rectified halfwave voltage is output across leads 424 and 426. The rectified voltage is then smoothed by a suitable high inductance filter 428 and the output current across leads 430 and 432 is applied to a suitable power storage device 434, e.g., one or more large capacitors 434 which provide an output at leads 436 and 438.

Output on leads 436 and 438 is applied to a switching power regulator 440 which provides a constant voltage output at leads 442 and 444.

The voltage across leads 436 and 438 is also sensed by the microprocessor based electronic control package 152. The control package 152 includes a suitable threshold detector (not shown) which detects a predetermined voltage at the outputs 436 and 438 of the power storage device 434, and in response to the sensed voltage will control the position of the on/off valve 412. Thus as shown in FIG. 9, the on/off valve 412 is normally in the open position wherein hydraulic fluid is flowing through the valve 412 and through the hydraulic motor 404 so that electrical power is continuously being generated and stored in the power storage device 434. When the electronic control package 152 detects a full charge across leads 436 and 438, it generates a signal which is directed to the on/off valve 412 causing it to move to a closed position 446, which causes the hydraulic motor 440 to stop turning. After the on/off valve 412 is moved to its off position 446, the switching power regulator 440 continues to draw current from power storage device 434 while providing a constant voltage direct current output across leads 442 and 444.

Although not illustrated in FIG. 9, the electronic control package 152 preferably draws its operating power from the output leads 442 and 444.

Subsequently, when the voltage output across leads 436 and 438 drops below a predetermined low threshold level, this will again be sensed by the electronic control package 152 and another signal will be sent to the on/-off valve 412 causing it to move back to its on position 445.

The electronic control package 152 additionally can be controlled in response to command signals sent from a remote location, which signals are sensed by sensor 164.

Figure 10:
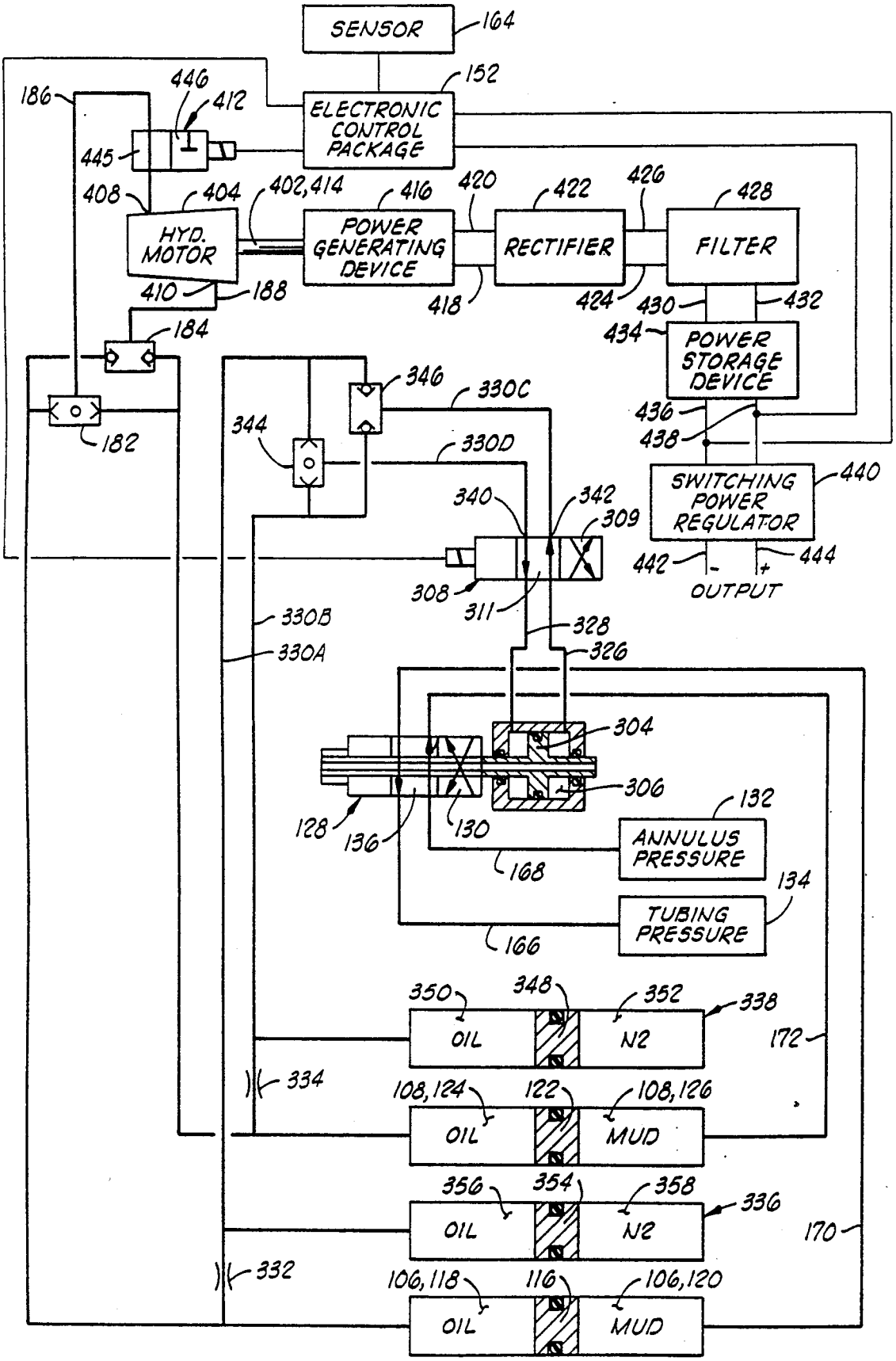
FIG. 10 is a schematic illustration of yet another embodiment of the invention, again utilizing a rotating power element and this time adding a pilot valve arrangement for control of the reversing valve much like that seen in FIG. 7.

The Embodiment of FIG. 10

In FIG. 10, another embodiment is shown for providing power to a rotating power transfer element 402 of a hydraulic motor 404, which then drives a power generation system like that generally described with regard to FIG. 9. The hydraulic system which provides hydraulic fluid to the hydraulic motor 404 differs in that a pilot valve means 308 has been added to control the operation of reversing valve means 128, rather than controlling the reversing valve means 128 directly from the electronic control package 152 as was shown in FIG. 9.

The pilot valve means 308 and associated hydraulics in FIG. 10 are substantially identical to those previously described above with regard to FIG. 7 and utilize the same identifying numerals for the components thereof as previously described above with regard to FIG. 7.

In the system of FIG. 10, the pilot valve means 308 is controlled by electrical signals from the electronic control package 152. The pilot valve means 308 applies a pressure differential across a differential pressure actuating piston means 304 which in turn operates the reversing valve means 28.

The pressure differential applied by pilot valve means 308 across the differential pressure actuating piston means 304 is obtained from the pressure differential which exists in the isolation chambers 106 and 108 through the use of time delay means 332 and 334 along with fluid pressure accumulator means 336 and 338. The high pressure is provided through high pressure shuttle check valve means 344 to the high pressure inlet 340 of reversing valve means 308. Similarly, the low pressure from low pressure outlet 342 of pilot valve means 308 is communicated through low pressure shuttle check valve 346.

The purpose of the fluid flow restrictor time delay means 332 and 334 and the fluid pressure accumulators 336 and 338 in association with the pilot valve means 308 in FIG. 10 is the same as that described above with regard to the embodiment of FIG. 7.

Manner of Operation

Each of the downhole apparatus shown in FIGS. 2, 3, 4, 7, 8, 9 and 10 utilize a pressure differential between high and low pressure zones, typically the well annulus and the tubing string bore, as an endless power source which is capable of moving the power transfer element, e.g., power piston 110 or rotating power transfer element 402, of the tool through an endless or unlimited number of operating cycles. The only limitation upon the number of cycles through which the power transfer element can be moved is the limit upon the electrical energy contained in batteries or other energy source 162 for powering the electronic control package 152. The electrical power requirements of the tool, however, are relatively minimal in that electrical energy is merely used to power the sensor 164, the electronic control package 152 and associated microprocessors contained therein, and the relatively small solenoid valves controlled thereby. The source of power for performing the relatively large mechanical manipulations to open and close the operating element 178 of the tool are, however, powered by the energy present in the hydraulic pressure differential between the high and low pressure zones 132 and 134.

Also, the electrical power generating systems like those of FIGS. 9 and 10 can be used instead of batteries in which case the available electrical power is also limitless.

Without repeating all of the explanation of the manner of operation of each of the various systems described above by way of example a typical system utilizing the present invention in one of the embodiments of FIGS. 2, 3 or 4 will be operated generally in the manner summarized below.

With reference to FIG. 1, a testing string 34 may include a formation tester valve 60 and/or a reverse circulation valve 58 either of which may be constructed in accordance with the system set forth in FIGS. 2, 3 and 4. That test string is lowered into place in the well and the packer 46 is set so as to isolate the upper well annulus 40 from the rat hole 20.

In most commonly encountered situations, the pressure from formation 18 which is communicated with the bore of the tubing string 34 will be several hundred psi less than the hydrostatic pressure in well annulus 40 at the depth of the tool in question, and thus a sufficient pressure differential will be present to operate the power piston 110 without the application of any additional hydraulic pressure to either the tubing string or the well annulus. If, however, there is not sufficient excess hydrostatic pressure in the well annulus 40, the pressure in the well annulus 40 can be increased by applying pressure thereto with pump 38 and maintaining that pressure substantially constant so that a sufficient pressure differential will be present between well annulus 40 and the rat hole 20 to move the power piston 110 and open and close the operating element 178.

When it is desired to move the operating element 178 between two or more positions thereof, an appropriate command signal is transmitted from a surface location such as the work deck 26 in any one of many possible means further described below. That command signal is received by the sensor 164 which generates a signal which is communicated to a microprocessor contained in the electronic control package 152 which in response generates a signal transmitted to the operating valve means 138 to move it between its first and second positions 140 and 142 so as to move the power piston 110 in the desired direction to operate the operating element 178. When it is desired to reclose or reopen the operating element 178 another command signal is sent and the operating valve means 138 reverses its position to again stroke the power piston 110. This can be repeated an endless number of times so long as there is sufficient power in the batteries 162 to maintain power to the electronic control package 152.

The pressure differential between the well annulus 40 and the dump chamber 20, which may be more generally referred to as a high pressure zone 132 and a low pressure zone 134, is continuously communicated to the operating valve means 138 through the isolation chambers 106 and 108 and the reversing valve means 128. In the system illustrated in FIG. 2, the reversing valve means 128 is in its second position 136 so that high fluid pressure from the well annulus is transmitted through the second isolation chamber 108, and so that low fluid pressure from the tubing bore is transmitted through the first isolation chamber 106.

When the second isolation piston 122 reaches the upper end of its stroke, the relationship of the isolation chambers 106 and 108 will be reversed by a change in position of the reversing valve means 128 to its first position 130 so that high pressure is then communicated through the first isolation chamber 106 while low pressure is communicated through the second isolation chamber 108.

Thus the pressure differential between the well annulus 40 and the rat hole 20 is constantly available to the operating valve means 138 and thus to the power piston 110, but at the same time the power piston 110 is isolated from contact with the relatively dirty well fluids contained in the well annulus 40 and the bore of tubing string 34.

The system illustrated in FIGS. 2, 3 and 4 and particularly the operating valve means 138, first and second isolation chambers 106 and 108, and reversing valve means 128 can generally be described as an energy conversion means for converting a hydraulic differential pressure potential energy between the first and second zones 132 and 134 of the well into mechanical kinetic energy of the power piston 110 as well fluid flows from the first zone 132 through the downhole tool apparatus 100 and into the second zone 134. This flow of fluid is of course intermittent. When it is desired to stroke the power piston 110, a volume of fluid equal to that displaced by the power piston 110 flows into the chamber which is at that time associated with a high pressure source, such as the well side chamber portion 126 of second isolation chamber 108 seen in FIG. 2. Substantially simultaneously therewith, an equal volume of well fluid is displaced from the well side fluid chamber 120 of the other isolation chamber 106 into the low pressure zone 134.

All of the well fluid that flows from the high pressure zone 132 to the low pressure zone 134 is retained in the downhole tool apparatus 100 during a plurality of operating strokes of the power piston 110. That is, any given slug of fluid which flows from the high pressure zone 132 into the well side chamber portion 126 of second isolation chamber 108 will remain there until such time as the reversing valve means 128 is reversed and the second isolation piston 122 begins to move downward thus forcing that fluid back out of the second well side chamber portion 126 and into the low pressure zone 134.

It is also noted that the isolation pistons 116 and 122 could of course be multiple stage pistons so as to multiply the pressure transmitted to the power piston 110 in which case the flow rate of fluid through the tool 100 would not be equal to the rate of displacement of fluid by the power piston 110, but it would be proportional thereto.

One additional feature of the apparatus shown in FIGS. 2–4 is that the tool will operate equally well regardless of which of the two zones 132 and 134 is the higher pressure zone. That is, a tool designed to operate on the pressure differential between the well annulus 40 and the bore of the tubing string 34 with the well annulus 40 having a higher pressure than the bore of the tubing string 34, will also operate equally well if the pressure differential is reversed and the higher pressure is present in the tubing string bore. Thus, the system previously described can generally be referred to as a pressure transfer control means for applying a pressure differential between the first and second zones 132 and 134 across the power piston 110 to operate the tool 100 regardless of which of the first and second zones 132 and 134 contains the higher fluid pressure.

In some situations it is even possible that it will not be certain whether the higher pressure is contained in the well annulus 40 or in the bore of the tubing string 34 at the depth of the tool in question. In such a situation, operation of the tool 100 can still be assured in the following manner. The pressure in the well annulus 40 can be temporarily increased above hydrostatic pressure by an amount sufficient to provide a satisfactory operating pressure differential between the well annulus and the tubing string bore if in fact those two pressures are substantially identical prior to increase of the well annulus pressure. That increased well annulus pressure can be maintained for a period of time and then released for an equivalent period of time and then again applied, and so on. If it turns out that the tubing pressure is higher than the hydrostatic well annulus pressure, the tool will operate when the additional annulus pressure is not present. This will assure that in either the natural condition or in the pressure applied condition, the tool 100 will operate.

Various advantages are provided by the present invention. One advantage is that little or no surface pressure need be applied to the well for operation of the system.

Another advantage is that little on-board electrical energy is required because the system takes advantage of the available energy potential produced by the differential pressure between the well annulus and the tubing bore. Using the embodiments of FIGS. 9 and 10, a tool can be provided which requires no on-board electrical battery type energy storage system.

The safety of the tool is enhanced as compared to those tools which utilize compressed nitrogen systems. Also, in comparison with those systems utilizing compressed nitrogen, there is enhanced reliability and ease of operation through the elimination of the temperature effects associated with compressed nitrogen systems.

Also, the system is highly versatile since it can be used with many different remote control systems.

Techniques for Remote Control

Many different systems can be utilized to send command signals from the surface location 26 down to the sensor 164 to control the tool 100.

One suitable system is the signaling of the control package 152, and receipt of feedback from the control package 152, using acoustical communication which may include variations of signal frequencies, specific frequencies, or codes of acoustical signals or combinations of these. The acoustical transmission media includes tubing string, casing string, electric line, slick line, subterranean soil around the well, tubing fluid, and annulus fluid. An example of a system for sending acoustical signals down the tubing string is seen in U.S. Pat. Nos. 4,375,239; 4,347,900; and 4,378,850 all to Barrington and assigned to the assignee of the present invention.

A second suitable remote control system is the use of a mechanical or electronic pressure activated control package 152 which responds to pressure amplitudes, frequencies, codes or combinations of these which may be transmitted through tubing fluid, casing fluid, fluid inside coiled tubing which may be transmitted inside or outside the tubing string, and annulus fluid. The system can also respond to a sensed downhole pressure.

A third remote control system which may be utilized is radio transmission from the surface location or from a sub-surface location, with corresponding radio feedback from the tool 100 to the surface location or subsurface location. The subsurface location may be a transmitter/receiver lowered into the well on a wireline.

A fourth possible remote control system is the use of microwave transmission and reception.

A fifth type of remote control system is the use of electronic communication through an electric line cable suspended from the surface to the downhole control package.

A sixth suitable remote control system is the use of fiberoptic communications through a fiberoptic cable suspended from the surface to the downhole control package.

A seventh possible remote control system is the use of acoustic signaling from a wire line suspended transmitter to the downhole control package with subsequent feedback from the control package to the wire line suspended transmitter/receiver. Communication may consist of frequencies, amplitudes, codes or variations or combinations of these parameters.

An eighth suitable remote communication system is the use of pulsed X-ray or pulsed neutron communication systems.

As a ninth alternative, communication can also be accomplished with the transformer coupled technique which involves wire line conveyance of a partial transformer to a downhole tool. Either the primary or secondary of the transformer is conveyed on a wire line with the other half of the transformer residing within the downhole tool. When the two portions of the transformer are mated, data can be interchanged.

All of the systems described above may utilize an electronic control package 152 that is microprocessor based.

It is also possible to utilize a preprogrammed microprocessor based control package 152 which is completely self-contained and is programmed at the surface to provide a pattern of operation of the downhole tool which it controls. For example, a remote signal from the surface could instruct the microprocessor based electronic control package 152 to start one or more preprogrammed sequences of operations. Also the preprogrammed sequence could be started in response to a sensed downhole parameter such as bottom hole pressure. Such a self-contained system may be constructed in a manner analogous to the self-contained downhole gauge system shown in U.S. Pat. No. 4,866,607 to Anderson et al., and assigned to the assignee of the present invention.

Thus it is seen that the apparatus and methods of the present invention readily achieve the ends and advantages mentioned as well as those inherent therein. While certain preferred embodiments of the invention have been described and illustrated for purposes of the present disclosure, numerous changes may be made by those skilled in the art which changes are encompassed within the scope and spirit of the present invention as defined by the appended claims.

What is claimed is:

1. A downhole tool apparatus, comprising:

a housing having a power chamber defined therein, and having power passage means defined in said housing for providing fluid pressure communication between said power chamber and first and second zones of a well; and pressure transfer control means for selectively applying a pressure differential between said first and second zones of said well across said power chamber to operate said downhole tool apparatus.

2. The apparatus of claim 1, further comprising:

a power piston slidably disposed in said power chamber; and wherein said pressure transfer control means is further characterized as a means for applying said pressure differential across said power piston repeatedly in alternating directions to repeatedly operate said tool.

3. A downhole tool apparatus, comprising:

a housing having a power chamber defined therein;

power passage means for providing fluid pressure communication between said power chamber and first and second zones of a well; and pressure transfer control means for using a pressure differential between said first and second zones of said well as a power source to said power chamber.

4. The apparatus of claim 3, further comprising:

a power piston slidably disposed in said power chamber; and wherein said pressure transfer control means is further characterized as being a means for moving said power piston through an unlimited number of operating strokes.

5. The apparatus of claim 3, wherein:

said pressure transfer control means is further characterized as being responsive to command signals transmitted from a surface location adjacent said well.

6. The apparatus of claim 3, further comprising:

a rotating power transfer element disposed in said power chamber.

* * * * *